US009326355B2

(12) United States Patent
Park et al.

(10) Patent No.: US 9,326,355 B2
(45) Date of Patent: Apr. 26, 2016

(54) CONTROL PANEL, CONTROL METHOD THEREOF AND CLOTHES TREATING APPARATUS HAVING THE SAME

(71) Applicant: LG Electronics Inc., Seoul (KR)

(72) Inventors: Youngbae Park, Seoul (KR); Noran Jung, Seoul (KR); Jimaeng Kim, Seoul (KR); Yongwoon Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/245,068

(22) Filed: Apr. 4, 2014

(65) Prior Publication Data

US 2014/0300272 A1 Oct. 9, 2014

(30) Foreign Application Priority Data

Apr. 4, 2013 (KR) ..... 10-2013-0037105

(51) Int. Cl.

| | |
|---|---|
| ***H01H 13/14*** | (2006.01) |
| ***H05B 37/02*** | (2006.01) |
| ***D06F 39/00*** | (2006.01) |
| ***D06F 33/02*** | (2006.01) |
| ***H05B 33/08*** | (2006.01) |

(52) U.S. Cl.

CPC ..... *H05B 37/02* (2013.01); *D06F 33/02* (2013.01); *D06F 39/005* (2013.01); *H05B 33/0803* (2013.01); *H05B 33/0824* (2013.01); *H05B 33/0845* (2013.01)

(58) Field of Classification Search

CPC ..... H01H 13/02; H01H 13/023; H01H 2013/026; H05B 373/02

See application file for complete search history.

(56) References Cited

U.S. PATENT DOCUMENTS

| | | | |
|---|---|---|---|
| 5,698,826 | A | 12/1997 | Cracraft et al. |
| 6,598,826 | B1 | 7/2003 | Therriault |
| 2002/0116959 | A1 | 8/2002 | Ohta |

(Continued)

FOREIGN PATENT DOCUMENTS

| | | | |
|---|---|---|---|
| DE | 102008030365 | A1 | 8/2009 |
| EP | 2 045 923 | A1 | 4/2009 |

(Continued)

OTHER PUBLICATIONS

Russian Decision on Grant dated Jun. 22, 2015 for Russian Application No. 2014110792, with English Translation, 15 Pages.

(Continued)

*Primary Examiner* — Jason M Crawford
*Assistant Examiner* — Kurtis R Bahr
(74) *Attorney, Agent, or Firm* — Fish & Richardson P.C.

(57) ABSTRACT

Disclosed are a control panel provided on an apparatus to control the apparatus, a control method thereof, and a clothes treating apparatus having the control panel. The control method includes the actions of receiving, at a clothes treating apparatus, a power supply command through a power input unit; and based on receiving power to the control panel, controlling a target light emission unit located on a panel body of the clothes treating apparatus. The controlling includes the actions of dividing a duty cycle of current supplied to each of a plurality of light emission units into a duty cycle of the target light emission unit and a duty cycle of a background light emission unit, the plurality of light emission units being located under the light discharge unit and being configured to emit light toward the light discharge unit.

17 Claims, 12 Drawing Sheets

(56) References Cited

U.S. PATENT DOCUMENTS

2003/0019734 A1 1/2003 Sato
2003/0107542 A1* 6/2003 Abe ..... G09G 3/22 345/89
2003/0150699 A1* 8/2003 Song ..... B29C 45/1418 200/5 A
2004/0004635 A1* 1/2004 King ..... A47L 15/4293 715/741
2004/0118872 A1 6/2004 Romanyszyn
2007/0013787 A1* 1/2007 Pippel ..... H01H 13/023 348/223.1
2007/0241938 A1 10/2007 Ulius-Sabel
2008/0276382 A1* 11/2008 Benne ..... D06F 39/005 8/158
2010/0156317 A1* 6/2010 Arai ..... G09G 3/342 315/294
2010/0231502 A1* 9/2010 Kondo ..... G09G 3/3406 345/102
2011/0109228 A1* 5/2011 Shimomura ..... H05B 37/0245 315/113
2011/0279281 A1 11/2011 Han
2012/0017457 A1* 1/2012 Bae ..... D06F 58/203 34/90
2012/0194493 A1* 8/2012 Soto ..... G09G 3/3406 345/207
2012/0241303 A1* 9/2012 Roose ..... D06F 39/005 200/530
2013/0057165 A1 3/2013 Ide
2014/0210359 A1* 7/2014 Raval ..... H02M 3/156 315/186

FOREIGN PATENT DOCUMENTS

JP H 10-127977 A 5/1998
KR 10-1998-0049442 B1 9/1998

OTHER PUBLICATIONS

European Search Report dated Jul. 24, 2015, for Application No. 14162354.6, 8 Pages.
Australian Notice of Acceptance dated Nov. 12, 2015 for Australian Application No. 2014201944, 3 pages.

* cited by examiner

CONTROL PANEL, CONTROL METHOD THEREOF AND CLOTHES TREATING APPARATUS HAVING THE SAME

CROSS REFERENCE TO RELATED APPLICATION

This application claims the benefit of Korean Patent Application No. 10-2013-0037105, filed on Apr. 4, 2013, which is hereby incorporated by reference as if fully set forth herein.

FIELD

The present disclosure relates to a control panel provided on an apparatus to control the apparatus, and more particularly, to a control panel of an electric home appliance, particularly, a clothes treating apparatus, a control method thereof, a clothes treating apparatus having the control panel, and a control method thereof.

BACKGROUND

In general, a clothes treating apparatus is an apparatus which removes various contaminants attached to clothes and bedclothes (a target to be washed) using emulsion action of detergent and frictional force and impulsive force of a water current due to rotation of a pulsator (or a drum).

Further, clothes treating apparatuses include an electric home appliance capable of drying laundry and an electric home appliance capable of washing and drying laundry as well as an electric home appliance capable of washing laundry.

A conventional clothes treating apparatus includes a control panel provided on a cabinet forming the external appearance of the clothes treating apparatus so as to input a control command, such as a washing course.

The control panel includes input units including buttons (having physical shapes) to supply power, to select one of courses, and to give a command to execute and stop the selected course, and a display unit to display the control command input through the input unit and/or a washing process of laundry to be washed.

SUMMARY

According to an innovative aspect of the subject matter described in this specification may be embodied in a control method of a control panel, the method including the actions of receiving, at a clothes treating apparatus, a power supply command through a power input unit; and based on receiving power to the control panel, controlling a target light emission unit located on a panel body of the clothes treating apparatus. The controlling includes the actions of dividing a duty cycle of current supplied to each of a plurality of light emission units into a duty cycle of the target light emission unit and a duty cycle of a background light emission unit, the plurality of light emission units being located under the light discharge unit and being configured to emit light toward the light discharge unit, where light emitted from the target light emission unit is brighter than light emitted from the background light emission unit, and where the plurality of light emission units are located adjacent to the light discharge unit and are configured to emit light towards the light discharge unit.

These and other embodiments can each optionally include one or more of the following features. A substantially equal amount of current is supplied to the plurality of light emission units. The duty cycle of the target light emission unit is greater than the duty cycle of the background light emission unit. The duty cycle of the target light emission unit is approximately four times the duty cycle of the background light emission unit. The plurality of light emission units is provided in a matrix including a plurality of light emission unit columns. Each light emission unit column receives substantially equal current in a regular cycle through scan lines. Data lines control a duty cycle in which a particular light emission unit receives current from a particular scan line. A timer controls supply times of current supplied from the scan lines. Current is supplied to a plurality of scan lines at different times and is supplied to a respective scan line according to a designated cycle of the timer.

The timer supplies current to the scan lines according to a plurality of current supply times. The plurality of current supply times includes 1 ms, 875 μs, 750 μs, 625 μs, 500 μs, 375 μs, 250 μs, and 125 μs. The control panel includes a controller that operates the clothes treating apparatus according to a control command input through one or more input units. The controller transmits a signal to each light emission unit through the data lines, the signal connecting a respective light emission unit to a respective scan line. The controller transmits a first signal to the target light emission unit through the data lines, the first signal connecting the target light emission unit to the scan line and separating the target light emission unit from the scan line in the duty cycle of the target light emission unit.

The controller transmits a second signal to the background light emission unit through the data lines and not to the target light emission unit, the second signal connecting the background light emission unit to the scan line and separating the background light emission unit from the scan line in the duty cycle of the background light emission unit. The target light emission unit is preset. The target light emission unit is set through selection of input units by a user. The target light emission unit is configured to emit light at a first level. The background light emission units are configured to emit light at a second level, the first level being brighter than the second level.

Based on receiving power to the control panel, the background light emission unit is configured to emit light at the second level and the target light emission unit, which is set through selection of one or more input units by a user, is configured to emit light at the first level. Based on receiving power to the control panel, the target light emission unit and the background light emission unit are gradually brightened in stages. After the target light emission unit and the background light emission unit are gradually brightened, the target light emission unit maintains light emission at the first level and the background light emission unit is gradually darkened and maintains light emission at the second level.

Based on receiving power to the control panel, the target light emission unit and the background light emission unit are brightened in the state of the brightest level. The target light emission unit maintains light emission at the first level and the background light emission unit is gradually darkened and maintains light emission at the second level. The light discharge unit displays control commands selectable by a user through one or more input units on the panel body of the control panel. The light emission unit corresponding to a control command selected through the one or more input units is controlled by the duty cycle of the target light emission unit.

According to an innovative aspect of the subject matter described in this specification may be embodied in a control panel of a clothes treating apparatus that includes a panel body that defines an external appearance of the control panel;

a light discharge unit that is located on the panel body and that includes at least one characters, figures, or marks; light emission units located adjacent to the light discharge unit and configured to emit light toward the light discharge unit; and a control unit configured to control brightness of the emitted light from the light emission units, where the control unit controls a target light emission unit by dividing a duty cycle of current supplied to each of the light emission units into a duty cycle of the target light emission unit and a duty cycle of the background light emission unit, where light emitted from the target light emission unit is brighter than light emitted from the background light emission unit.

These and other embodiments can each optionally include one or more of the following features. The control unit includes a controller; scan lines to which current is supplied; a timer connecting the scan lines to the controller and supplying current to the scan lines according to a predetermined cycle; and data lines that receive current from the scan lines and supply the received current to the light emission units based on a duty cycle provided by the controller. The light emission units are provided in a matrix including a plurality of light emission unit columns. Each light emission unit column receives substantially equal current in a regular cycle through the scan lines. Data lines control the duty cycle in which a particular light emission unit receives current from a particular scan line.

DETAILED DESCRIPTION

Figure 1:
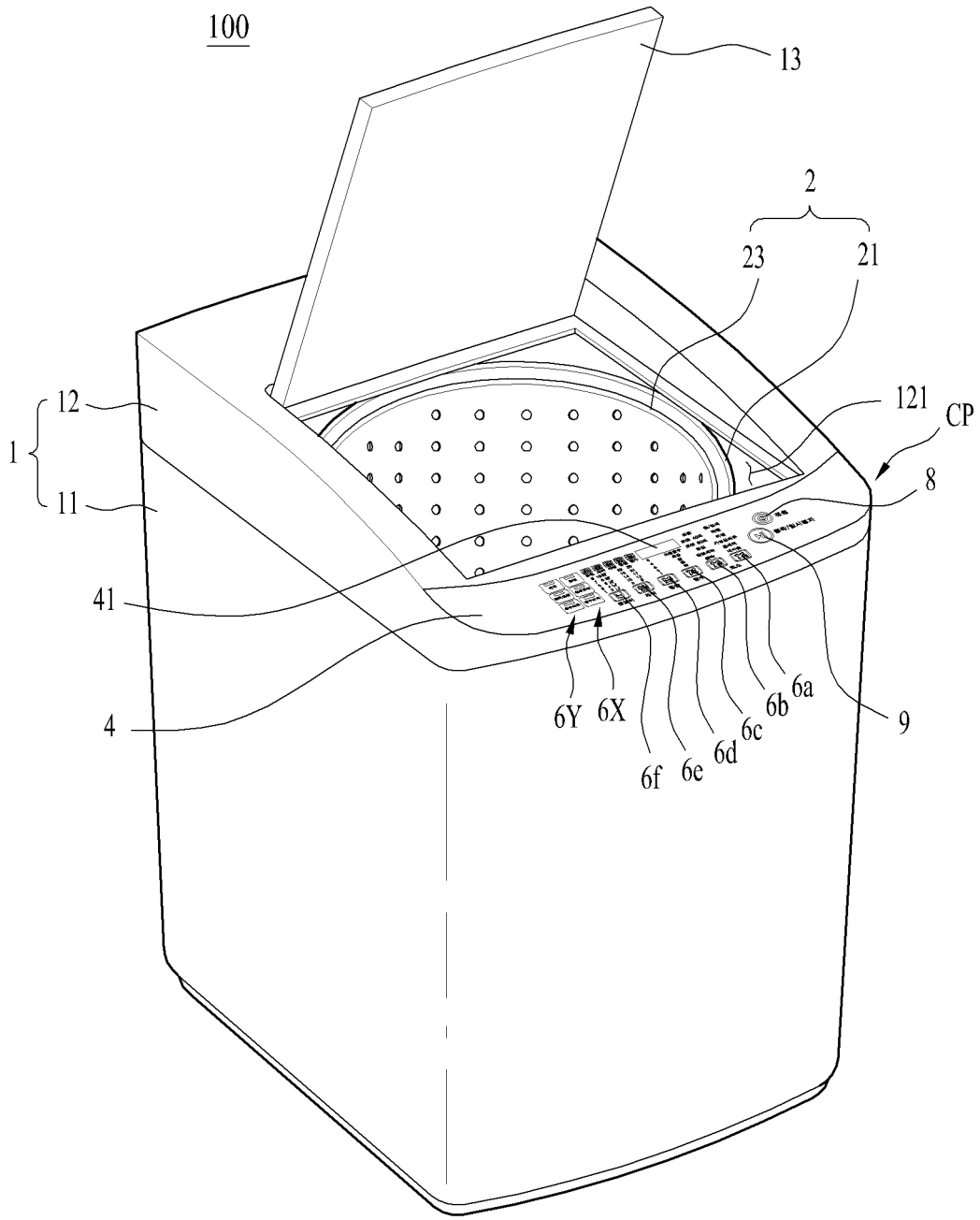
FIGS. 1 and 2 are views illustrating a clothes treating apparatus having a control panel.

As shown in FIG. 1, a clothes treating apparatus 100 may include a cabinet 1, a clothes receipt unit 2 provided within the cabinet 1 to receive clothes, and a control panel CP provided on the cabinet 1 so that a user may input a control command to the clothes treating apparatus 100 through the control panel CP.

The cabinet 1 may include a cabinet body 11 having a hexahedral shape, the upper surface of which is opened, and a cover 12 provided on the opened surface of the cabinet body 11.

An inlet 121 is provided on the cover 12 so that a user may put clothes into or withdraw clothes from the clothes receipt unit 2 through the inlet 121. The inlet 121 may be opened and closed by a door 13 rotatably combined with the cover 12.

Figure 2:
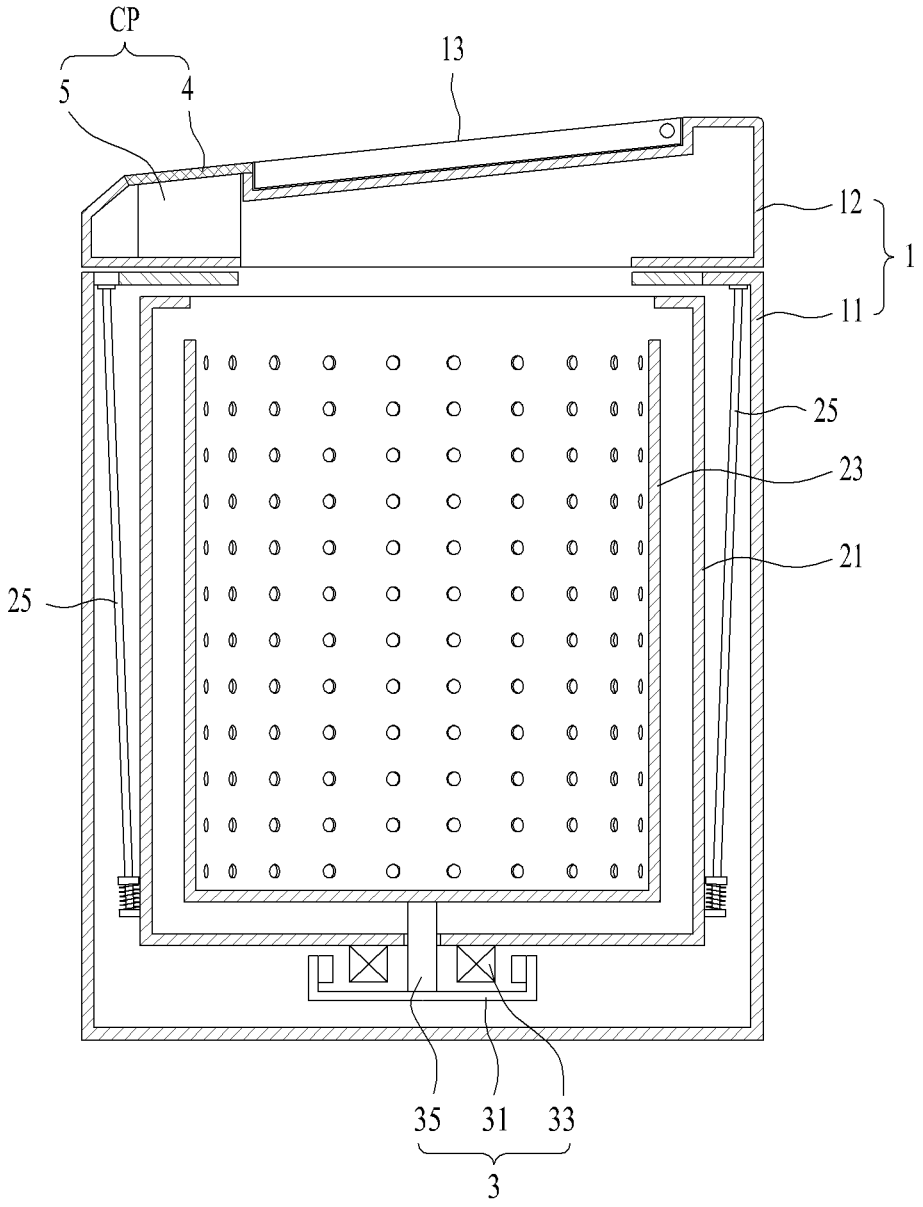

As shown in FIG. 2, the clothes receipt unit 2 may include a tub (or outer tub) 21 provided within the cabinet 1 and storing wash water, and a drum (or inner tub) 23 rotatably provided within the tub 21 and receiving clothes.

The tub 21 may be fixed to the inside of the cabinet 1 by tub support units 25 connecting the inner circumferential surface of the cabinet 1 and the outer circumferential surface of the tub 21, and the tub support units 25 may be provided as structures (springs or dampers) capable of absorbing vibration generated on the tub 21.

The tub 21 may receive wash water supplied through a water supply unit and wash water in the tub 21 may be discharged to the outside of the tub 21 through a drain unit.

The water supply unit may include water supply hoses connecting a water supply source provided at the outside of the clothes treating apparatus 100 to the tub 21, and water supply valves opening and closing the water supply hoses under the control of a control unit.

The drain unit may include a drain hose communicating the inside of the tub 21 with the outside of the cabinet 1, and a drain pump provided in the drain hose.

A plurality of through holes, through which wash water stored in the tub 21 is introduced into the drum 23 and wash water in the drum 23 is discharged to the tub 21, is provided on the drum 23 and the drum 23 is rotated by a driving unit 3, such as a motor.

The driving unit 3 may include a stator 33 fixed to the outside of the tub 21, a rotor 31 located at the outside of the tub 21 and rotated by electromagnetic interaction with the stator 22, and a rotary shaft 35 connecting the rotor 31 to the drum 23.

In some implementations, the rotary shaft 35 passes through the bottom surface of the tub 21 and is fixed to the bottom surface of the drum 23, and a bearing assembly which prevents leakage of wash water in the tub 21 and rotatably supports the rotary shaft 35 may be provided on the tub 21.

Figure 3:
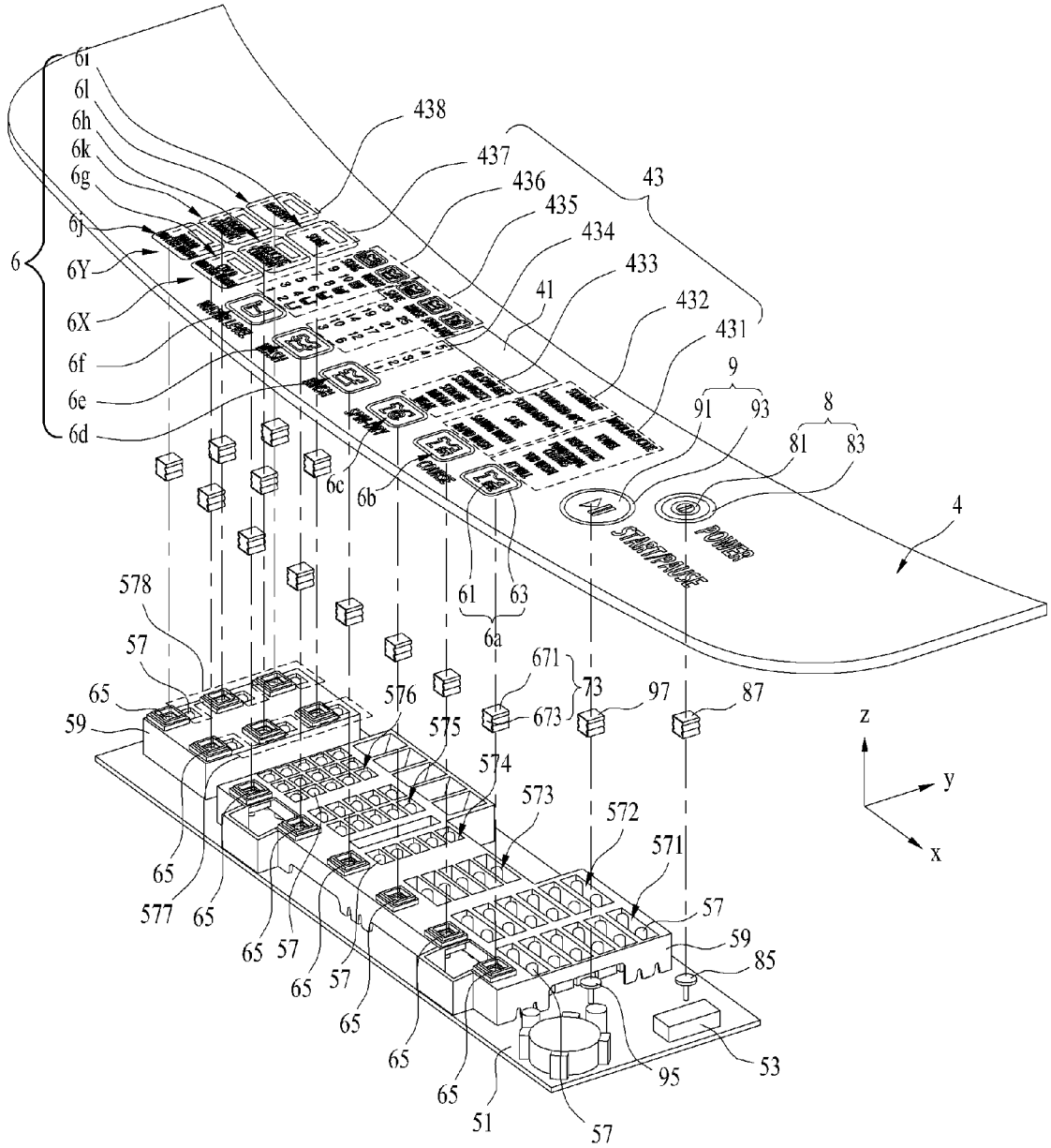
FIG. 3 is an exploded perspective view of the control.

As shown in FIG. 3, the control panel CP may include a panel body 4 provided on the surface of the cabinet 1 (i.e., the upper surface or the front surface of the cover 12), a control unit 5 fixed to the inside of the cabinet 1 and located under the panel body 4, and input units 6 transmitting a control command input by a user to the control unit 5.

The panel body 4 may be provided as a plate and include a transparent window 41 and light discharge units 43.

The panel body 4 may be inserted into a hole formed through the body 12 so as to be coplanar with the surface of the cover 12, or be provided by forming the transparent window 41 and the light discharge units 43 on the surface of the cover 12.

The transparent window 41 may be provided in various forms so that a user may confirm an object or displayed information located under the panel body 4 and be provided by forming a part of the panel body 4 of a transparent material.

The light discharge units 43 are provided on the surface of the panel body 4 so that light emitted from light emission units 57, which will be described later, may pass through the panel body 4. The light discharge units 43 may be provided in the form of characters, figures, or marks recognizable by a user.

If the light discharge units 43 are provided in the form of characters, figures, or marks recognizable by a user, the light discharge units 43 may function as a control command display unit to display control commands (a course, a supplied water amount, a drum rotation time, a supplied water temperature, a rotational speed of the drum, etc.) which are selectable by the user through the input units 6, on the panel body 4. Therefore, the user may recognize control commands, displayed by the light discharge units 43, by light emitted from the light emission units 57.

The light discharge units 431 to 438 may not only serve to display control commands selectable by the user among control commands (a washing course, a drying course, etc.) executable by the clothes treating apparatus 100 on the panel body 4 but also serve to display control commands changeable by the user among control commands (a supplied water amount, a drum rotation time, a supplied water temperature, a rotational speed of the drum, etc.) preset in a specific course.

In some implementations, the light discharge units 43 may execute the above-described functions while the light emission units 57, which will be described later, emit light. That is, while the light emission units 57 emit light, display and selection of control commands may be possible.

The surface of the panel body 4 may be coated or painted with a material of an achromatic color or a chromatic color. Such coating or painting may be carried out in remaining regions except for regions in which characters or marks to be displayed through the light discharge units 43 are located, among regions of the panel body 4.

Particularly, if the panel body 4 is coated or painted with a material of an achromatic color, such as black, a user may not recognize the light discharge units 43 on the panel body 4 unless the light emission units 57 emit light. The inside of the control panel CP maintains a dark state and thereby, the user may feel compactness and refinement in design of the control panel CP.

That is, when the light emission units 57 do not emit light, the entirety of the panel body 4 as well as characters or marks on the light discharge units 43 may be expressed in black. That is, the entirety of the panel body 4 may be recognized as a black display panel. In some implementations, when the light emission units 57 emit light, the user may easily recognize characters or marks on the light discharge units 43.

The light discharge units 43 may be provided in the same number as the number of the input units 6, and be provided to form the same number of columns as the number of the input units 6. Further, the column corresponding to one input unit 6 may have a plurality of light discharge units 43.

FIG. 3 illustrates the case that some of the light discharge units 43 are provided to form the same number of columns as the number of the input units 6 and the remainder of the light discharge units 43 are provided in the same number as the number of the input units 6.

That is, FIG. 3 illustrates the control panel CP including six input units 6*a* to 6*f* provided in the length direction (in the X-axis direction) of the panel body 4 and two input unit columns, i.e., a first input unit column 6X and a second input unit column 6Y, provided in the height direction (in the Y-axis direction) of the panel body 4. Therefore, a plurality of light discharge units 43 may correspond to one input unit, i.e., one of the input units 6*a* to 6*f*, and one light discharge unit 43 may correspond to each of one input unit, i.e., one of the input units 6*i* to 6*l*.

In some implementations, the light discharge units 43 include eight light discharge unit columns, i.e., a first light discharge unit column 431, a second light discharge unit column 432, a third light discharge unit column 433, a fourth light discharge unit column 434, a fifth light discharge unit column 435, a sixth light discharge unit column 436, a seventh light discharge unit column 437, and an eighth light discharge unit column 438.

In some implementations, the above-described number of light discharge unit columns may be increased or decreased. Hereinafter, for convenience of description, a control panel CP including eight light discharge unit columns will be described.

The control unit 5 may include a PCB 51 including a controller 53 operating the clothes treating apparatus 100 according to control commands input through the input units 6, a display unit 55 fixed to the PCB 51, controlled by the controller 53, and located under the transparent window 41, and light emission units 57 (LEDs, etc.) fixed to the PCB 51 and located under the light discharge units 43.

The display unit 55 serves to display operation information of the clothes treating apparatus 100. For example, the operation information may be information related to a course selected by a user, such as a time set in the course (a washing course, a drying course, etc.) selected by the user through the input units 6 and a residual time of the course selected by the user.

The light emission units 57 serve to emit light toward the light discharge units 43 from below so that a user may easily recognize characters, figures, or marks displayed by the light discharge units 43.

The number of the light emission units 57 may be the same as the number of the light discharge units 43. That is, one light emission unit 57 and one light discharge unit 43 may correspond to each other one-to-one.

Therefore, the light emission units 57 form the same number of columns as the number of the columns formed by the light discharge units 43. If the light discharge units 43 form eight columns 431 to 438, the light emission units 57 may form eight light emission unit columns, i.e., a first light emission unit column 571, a second light emission unit column 572, a third light emission unit column 573, a fourth light emission unit column 574, a fifth light emission unit column 575, a sixth light emission unit column 576, a seventh light emission unit column 577, and an eighth light emission unit column 578.

However, if the length of the light discharge units 43 (the length of the light discharge units 43 in the X-axis direction) or the height of the light discharge units 43 (the length of the light discharge units 43 in the Y-axis direction) is long, two or more light emission units 57 may be provided under one light discharge unit 43. FIG. 3 exemplarily illustrates two light emission units 57 as being provided under each of the light discharge units 43 corresponding to course input units 6*a* and 6*b* and one light emission unit 57 as being provided under each of the light discharge units 43 corresponding to a spin-drying input unit 6*c*.

In some implementations, the light emission units 57 may be provided to form the same number of columns as the number of the input units 6*a* to 6*f*. The reason for this is to control one light emission unit column 571, 572, 575, or 576 through one input unit 6*a*, 6*b*, 6*e*, or 6*f*.

Further, the light emission units 57 may be supported by light emission unit housings 59 fixed to the PCB 51.

The light emission unit housing 59 may include a plurality of reception holes 591 formed through the light emission unit housing 59 and surrounding the outer circumferential surfaces of the light emission units 57. The reception holes 591 may be extended from the PCB 51 to a height equal to or higher than the upper ends of the light emission units 57.

When the light emission units 57 are inserted into the reception holes 591 and combined with the PCB 51, light emitted from a specific light emission unit 57 may be supplied only to the light discharge unit 43 located above the specific light emission unit 57, thus improving visibility.

That is, discharge of light to light discharge units 43 other than the light discharge unit 43 located above the light emission unit 57 emitting such light may be minimized.

The input units 6 may be eight input units 6 provided in the length direction of the panel body 4 (in the X-axis direction).

To illustrate that the control panel CP is deformable to have various types in design through arrangement of the input units 6, FIG. 3 illustrates the case that six input units 6*a* to 6*f* are provided in the length direction of the panel body 4 and two input unit columns 6X and 6Y are provided in the height direction of the panel body 4 (in the Y-axis direction).

In some implementations, the first input unit column 6X may be formed by two or more input units 6*g*, 6*h*, and 6*i* arranged in the height direction of the panel body 4, and the second input unit column 6Y may be formed by two or more input units 6*j*, 6*k*, and 6*l* arranged in the height direction of the panel body 4.

Hereinafter, for convenience of description, one implementation will be described based on the control panel CP including six input units 6*a* to 6*f* provided in the length direction of the panel body 4 and two input unit columns 6X and 6Y provided in the height direction of the panel body 4.

The above-described respective input units 6*a* to 6*l* may have the same structure.

That is, each of the input units 6*a* to 6*l* may include a contact part 61 provided on the surface of the panel body 4 so that bioelectric currents of a user are input to the contact part 61, a bar 65 electrically connected to the controller 53, and a connection damper 67 electrically connecting the bar 65 and the contact part 61.

The bar 65 is formed of a conductor and located under the contact part 61. It is desirable that the bar 65 is fixed to the PCB 51.

The contact part 61 may be formed of any material which may transmit bioelectric currents of the user to the connection damper 67. That is, the contact part 61 may be formed of a conductor passing through the panel body 4, or formed of an insulator having a small thickness.

Since such an insulator having a small thickness is not a perfect insulator which completely cut off electrical conduction, even if the contact part 61 is formed of an insulator of less than a designated thickness, bioelectric currents of the user may be transmitted to the connection damper 67. The applicant has confirmed that the function of the input unit 6 may be implemented through the contact part 61 formed of plastic having a thickness of 2.7 to 3.0 millimeters.

Further, if the contact part 61 is formed of an insulator having a small thickness, the input unit 6 may further include a boundary part 63 in the form of a closed curve surrounding the outer circumferential surface of the contact part 61.

The boundary part 63 may be formed of a conductor fixed to the surface of the panel body 4 so as to surround the outer circumferential surface of the contact part 61. The reason for this is to concentrate bioelectric currents of the user on the boundary part 63 formed of a conductor and thus to prevent bioelectric currents from moving to the outside of the contact part 61.

The connection damper 67 may be fixed to the upper surface of the bar 65. Further, the connection damper 67 may include a conductor 671 connecting the contact part 61 and the bar 65.

If the connection damper 67 includes the conductor 671 alone, manufacturing costs of the control panel CP increase and, when impact is applied to the control panel CP, the connection damper 67 may break.

Therefore, the connection damper 67 may further include an elastic body 673. In some implementations, the outer circumferential surface of the elastic body 673 may be surrounded with the conductor 671. Therefore, the conductor 671 executes transmission of bioelectric currents, and the elastic body 673 executes impact absorption.

As shown in FIG. 3, the control panel CP i may include a plurality of input units 6*a* to 6*l*. The input units 6*a* to 6*f* provided in the length direction of the panel body 4 may control the light emission units 57 under the light discharge unit columns 431 to 436 located at positions corresponding to these input units 6*a* to 6*f*.

In some implementations, one input unit located in one of the light emission unit columns 571, 572, 573, 574, 575, and 576 turns a plurality of light emission units 57 forming the light emission unit column 571, 572, 573, 574, 575, or 576 ON/OFF (ON: emitting light, OFF: not emitting light), or controls change of the position of the light emission unit 57 in the ON state.

In some implementations, whenever a user's body contacts the input unit 6, the controller 53 may sequentially supply power to the plurality of light emission units 57 forming the light emission unit column 571, 572, 573, 574, 575, or 576 (only one light emission unit emitting light).

Further, whenever a user's body contacts the input unit 6, the controller 53 may control the light emission units 57 so that the position of the light emission unit 57 brighter than other light emission units 57 sequentially moves.

The input units 6*g* to 6*i* forming the input unit first column 6X and the input units 6*j* to 6*l* forming the input unit second column 6Y are provided in the same number as the number of the light emission units 57 and thus, the controller 53 may control only the light emission units 57 located under the input units 6*g* to 6*l* sensing bioelectric currents (turning the light emission units 570N/OFF or controlling brightness of the light emission units 57).

The panel body 4 may further include a power input unit 8 controlling supply of power to an element requiring power supply, such as the driving unit 3 or the control unit 5, and a pause input unit 9 temporarily stopping operation of the clothes treating apparatus 100 or releasing temporary stoppage of the clothes treating apparatus 100.

The power input unit 8 and the pause input unit 9 may be provided as a push button which is operated only when a user presses the button at a designated pressure or more, or have the same structure as the above-described structure of the input units 6.

In some implementations, the power input unit 8 and the pause input unit 9 may include contact parts 81 and 91 provided on the surface of the panel body 4 so that bioelectric currents of a user may be input to the contact parts 81 and 91, boundary parts 83 and 93 in the form of a closed curve surrounding the outer circumferential surfaces of the contact parts 81 and 91, bar 85 and 95 electrically connected to the controller 53 and fixed to the PCB 51, and connection dampers 87 and 97 electrically connecting the bars 85 and 95 and the contact part 81 and 91.

If bioelectric currents are input at about the same time to several input units 6, 8, and 9 of the control panel CP having the above-described structure, a control command against user intention may be input to the clothes treating apparatus 100.

That is, the above described situation may occur if a user's body except for fingers contacts the panel body 4 and thus bioelectric currents are supplied to several input units or if a user's hand contacts the panel body 4 without user intention of inputting a control command and thus bioelectric currents are supplied at about the same time to several input units.

In some implementations, the control unit 5 may execute control, which will be described below.

First, the control unit 5 continuously judges whether or not bioelectric currents of a user are input through the input units 6, 8, and 9.

If bioelectric currents are input through the input units 6, 8, and 9, the control unit 5 judges through which input units bioelectric currents are input.

If bioelectric currents are input through one input unit, the control unit 5 controls the clothes treating apparatus 100 according to a control command input through the corresponding input unit.

That is, if bioelectric currents are input through one input unit, the control unit 5 supplies power to the clothes treating apparatus 100, temporarily stops operation of the clothes treating apparatus 100, re-operate the clothes treating apparatus 100, operation of which has been temporarily stopped, or controls the light emitting units 57 and the display unit 55 so that the user may confirm the selected control command.

If bioelectric currents are input through two or more input units, the control unit 5 judges whether or not an input interval of bioelectric currents exceeds a predetermined reference interval.

If the input interval of two or more bioelectric currents exceeds the reference interval (time), the control unit 5 sequentially executes respective control commands input through the input units. In some implementations, if the input interval of two or more bioelectric currents does not exceed the reference interval, the control unit 5 disregards control commands input through the input units.

That is, if the input interval of two or more bioelectric currents does not exceed the reference interval, the control unit 5 maintains the current state of the clothes treating apparatus 100. The control unit 5 continuously executes a control command which is being executed now if the clothes treating apparatus 100 is being operated, and controls the clothes treating apparatus 100 so that power is not supplied to the clothes treating apparatus 100 if the clothes treating apparatus 100 is not being operated.

Conventional control panels including light emission units (LEDs) control brightness of the light emission units by controlling the amount of current supplied to the light emission units. However, in some implementations, brightness of the light emission units 57 is adjusted by controlling a duty cycle of the light emission units 57.

The duty cycle is a value meaning a ratio of a time, during which current is supplied, to 1 cycle (a time during which current is supplied/the sum of the time during which current is supplied and a time during which current is not supplied), and 1 cycle means the sum of a time during which current is supplied to light emission units and a time during which current is not supplied to the light emission units.

Figure 4:
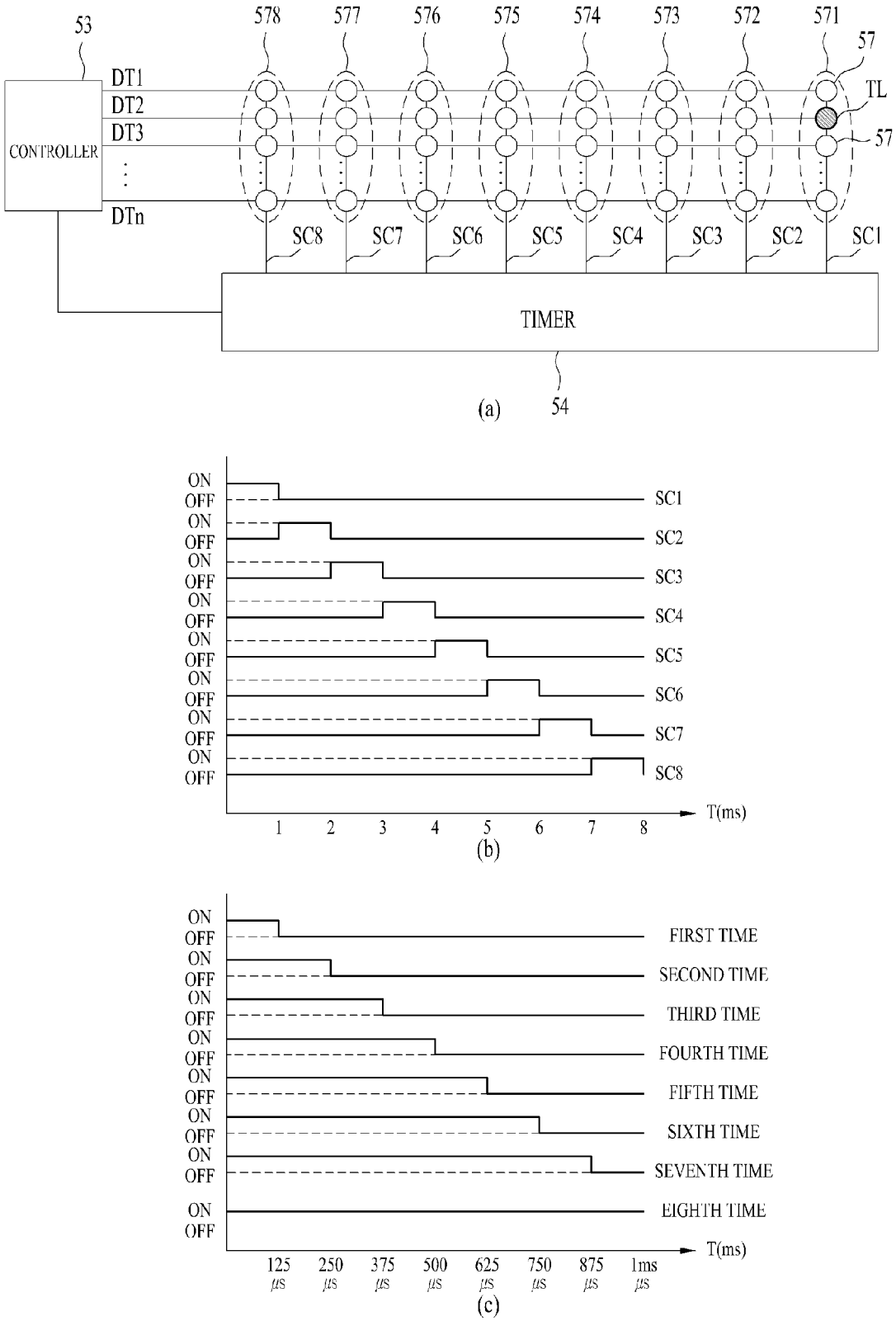
FIGS. 4(*a*) to 4(*c*) are a block diagram of a control unit provided on the control panel shown in FIG. 3, a graph of current supply cycles, and a graph of current supply times.

FIG. 4(*a*) illustrates the control unit 5 which may adjust brightness of the light emission units 57 by controlling the duty cycle of the light emission units 57 (or the ON/OFF cycle of the light emission units).

The light emission units 57 fixed to the PCB 51 are connected to the controller 53 through data lines DT1 to DTn and scan lines SC1 to SC8.

The data lines DT1 to DTn and the scan lines SC1 to SC8 may be structurally discriminated.

The data lines DT1 to DTn and the scan lines SC1 to SC8 differ from each other in that the data lines DT1 to DTn are connected directly to the controller 53 but the scan lines SC1 to SC8 are connected to the controller 53 via a timer 54. Further, the data lines DT1 to DTn and the scan lines SC1 to SC8 differ from each other in that the data lines DT1 to DTn are provided on the PCB 51 so that light emission units 57 forming one row are controlled by the controller 53 but the scan lines SC1 to SC8 are provided on the PCB 51 so that light emission units 57 forming one column are controlled by the controller 53 and the timer 54.

From a functional viewpoint, the respective scan lines SC1 to SC8 supply current of a designated intensity to the respective light emission unit columns 571 to 578 at a regular cycle but the data lines DT1 to DTn cause a specific light emission unit 57 to emit light (to turn the specific light emission unit 57 on/off) by controlling a time during which the specific light emission unit 57 receives current from a specific scan line (i.e., controlling a duty cycle).

The timer 54 may serve not only to control a supply time of current (of a regular intensity) supplied by one scan line (i.e., control a current supply cycle) (with reference to FIG. 4(*c*)) but also not to supply current at about the same time to all scan lines SC1 to SC8 but to supply current to the respective scan lines SC1 to SC8 according to a regular cycle, if plural scan lines are provided, (with reference to FIG. 4(*b*), i.e., to supply current to the respective scan lines at a regular cycle).

If 8 scan lines are provided, the timer 54 may supply current to the respective scan lines at a ⅛ cycle.

That is, as shown in FIG. 4(*b*), the timer 54 supplies current to the first scan line SC1 for one millisecond and then does not supply current to the first scan line SC1 until seven milliseconds has elapsed (for a time during which current is sequentially supplied to the second scan line SC2 to the eighth scan line SC8 for one millisecond).

If the timer 54 may control a current supply time in the unit of 125 μs at the minimum, the timer 54 may supply current to one scan line based on eight kinds of current supply times shown in FIG. 4(*c*), while current is supplied to one scan line. That is, when current is supplied at an eighth of a cycle, current may be supplied based on one of eight kinds of current supply times.

That is, on the assumption that the first scan line SC1 is a scan line to which current is supplied now, the timer 54 may supply current to the first scan line SC1 for the first time (125 μs) at the minimum to the eighth time (one millisecond) at the maximum.

A process of controlling brightness of the light emission units 57 through the control unit 5 having the above-described structure will be described, as follows.

The timer 54 sequentially supplies current to the respective scan lines SC1 to SC8 according to a set cycle. At this time, the controller 53 transmits a signal, connecting a specific light emission unit to a specific scan line, to the respective light emission units 57 through the data lines.

For example, the timer 54 supplies current of the same intensity to the respective light emission units 57 according to a preset cycle (one eighth of a cycle: supplying current for one millisecond and cutting off current for seven milliseconds).

At this time, the controller 53 transmits a signal, connecting a light emission unit (hereinafter, referred to as "a target light emission unit") TL located at the second row of the first light emission unit column 571 to a scan line for one millisecond and separating the target light emission unit TL from the scan line for seven milliseconds, to the target light emission unit TL through the data line DT2.

Further, the controller 53 transmits a signal, connecting the light emission units 57 except for the target light emission unit TL (hereinafter, referred to as "background light emission units") to scan lines for 0.5 milliseconds and separating the background light emission units 57 from the scan lines for 15.5 milliseconds, to the respective light emission units 57 through all data lines DT1, DT2, DT3, . . . , DTn.

In some implementations, the duty cycle of the target light emission unit TL becomes ⅛ (cycle of eight milliseconds) and the duty cycle of the background light emission units 57 becomes 1/32 (cycle of sixteen milliseconds). That is, the duty cycle of the target light emission unit TL may be 4 times the duty cycle of the background light emission units 57. Therefore, if current of the same intensity is supplied to the light emission units 57 and the duty cycle is varied, the target light emission unit TL emits light more brightly than the background light emission units 57. That is, if the current supply cycle of the background light emission units 57 is lengthened (the frequency of the background light emission units 57 is decreased), a user may feel that the target light emission unit TL is brighter than the remaining background light emission units 57.

Further, if the frequency of the light emission units 57 is not less than a critical frequency (about 10 Hz) at which flickering is recognizable by shortening a cycle at which power is supplied to the light emission units 57, the user may not recognize flickering of the light emission units 57. Therefore, the user may recognize that the target light emission unit TL continuously maintains a brighter state than the background light emission units 57.

The frequency in the duty cycle of the background light emission units 57 may be 31.25 Hz, and the frequency in the duty cycle of the target light emission unit TL may be 125 Hz. Therefore, the user may clearly recognize whether or not the target light emission unit TL and the background light emission units 57 emit light and a brightness difference between the target light emission unit TL and the background light emission units 57.

Therefore brightness of the light emission units may be controlled through control of the duty cycle of current supplied to the respective light emission units without change in intensity of current supplied to the respective light emission units.

Figure 5:
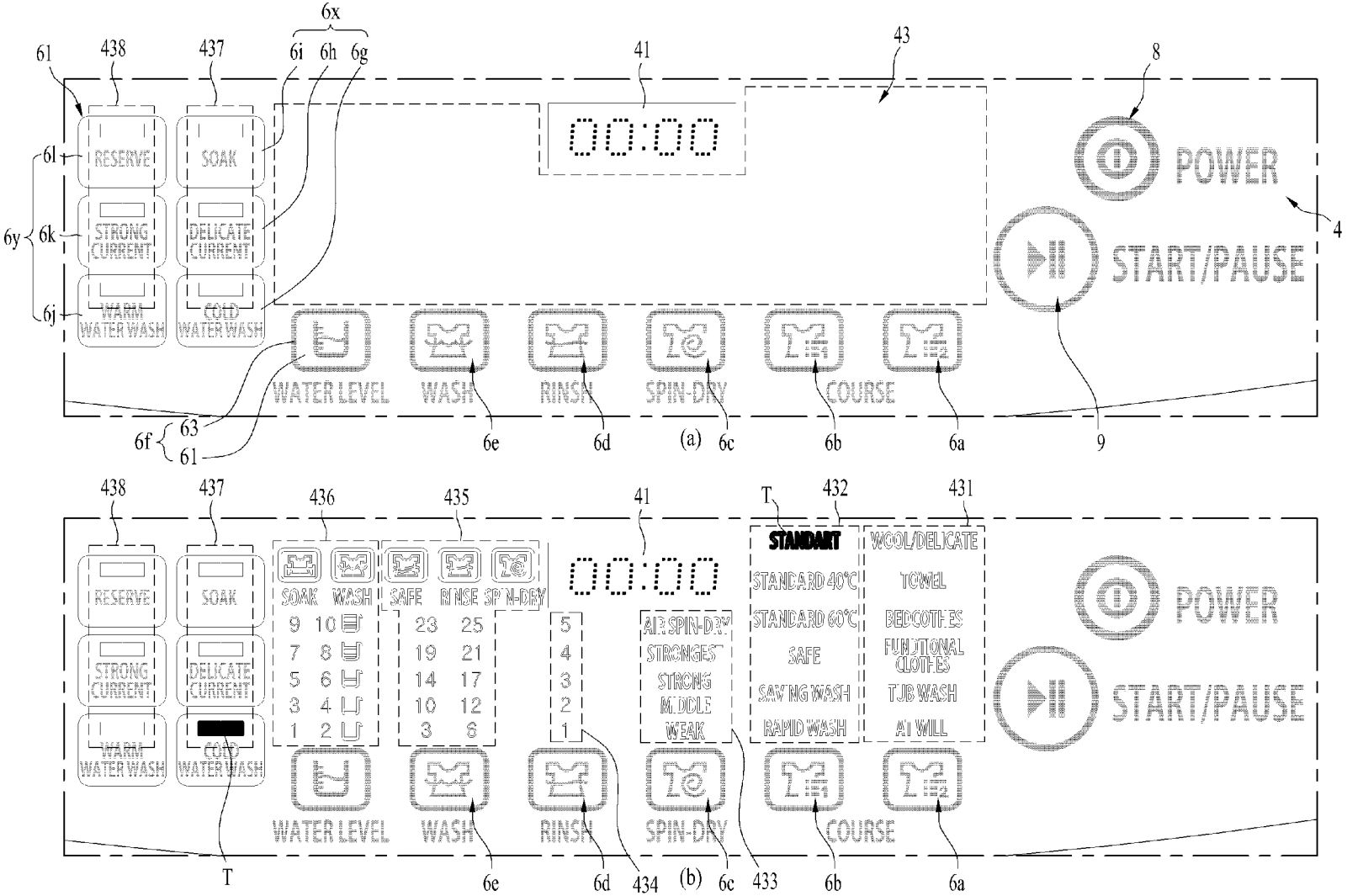
FIGS. 5(*a*) and 5(*b*) are views illustrating an operating process of the control panel shown in FIG. 3.

FIGS. 5(*a*) and 5(*b*) illustrate an operating process of the control panel CP when a user inputs a power supply command to the clothes treating apparatus 100 through the power input unit 8.

In some implementations, when a user inputs a control command (power supply command) to the clothes treating apparatus 100 through the power input unit 8, the light emission units 57 are controlled so that a predetermined target light emission unit TL alone maintains a bright state, and the remaining light emission units 57 have lower brightness than the target light emission unit TL.

The target light emission unit TL means a light emission unit 57 located under a target light discharge unit T and the target light discharge unit T means a light discharge unit 43 displaying a course having high frequency of use and detailed settings having high frequency of use.

The target light discharge unit T may be set by a user or set by a designer of the clothes treating apparatus 100. FIG. 5 illustrates the case that a light discharge unit displaying standard (normal) washing using cold water is set as the target light discharge unit T.

Since current is may not supplied to the light emission units 57 unless a user's body (a finger, etc.) contacts the power input unit 8, the user may not recognize the light discharge units 43 in the form of characters, figures, or marks unless current is supplied to the light emission units 57.

Such effects may be increased if the panel body 4 is coated or painted with a material of an achromatic color, such as black. Therefore, the entirety of the light emission units 43 may be recognized as a black panel display.

If a user's body contacts the power input unit 8, the timer 54 supplies current to one of the scan lines SC1 to SC8, selected according to the set cycle (supplying current for one millisecond/cutting off supply of current for seven milliseconds), for a set time (one of the first time to the eighth time of FIG. 4(*c*)).

At about the same time, the respective data lines DT1 to DT8 supply current to the respective light emission units 57 under control of the controller 53 so that the duty cycle of the target light emission unit located under the target light discharge unit T is greater than that of the remaining light emission units.

For example, if a user's body contacts the power input unit 8, the timer 54 selects one scan line in a cycle of eight milliseconds (supplying current for one millisecond/cutting off supply of current for seven milliseconds), and supplies current of a regular intensity to the selected scan line for a designated time (for example, for one millisecond (the eighth time).

At this time, the controller 53 transmits a control signal (duty cycle: ⅛ and frequency: 125 Hz), connecting a target light emission unit to a scan line for one millisecond and separating the target light emission unit from the scan line for seven milliseconds, to the target light emission unit, and transmits a control signal (duty cycle: 1/32 and frequency: about 31.25 Hz), connecting the background light emission units to scan lines for 0.5 milliseconds and separating the background light emission units from the scan lines for 15.5 milliseconds, to the background light emission units.

In some implementations, the frequencies of all light emission units including the target light emission unit are not less than the critical frequency (about 10 Hz) at which flickering is recognizable and thus, a user may not recognize flickering of the light emission units, and the duty cycle of the target light emission unit is greater than the duty cycle of the background light emission units and thus, the user may recognize that a course displayed by the target light discharge unit T located above the target light emission unit is selected.

Therefore the light emission units have frequencies at which flickering may not be recognizable, being not less than the critical frequency and thus, a user may not recognize flickering while adjusting brightness of the light emission units through control of the duty cycles of the light emission units.

Of course, in the state shown in FIG. 5(*b*), as the user presses a course input unit 6*b*, the target light emission unit is sequentially changed. That is, the target light emission unit of the second light emission unit column 432 corresponding to the course input unit 6*b* may be varied. Therefore, the user may recognize a selected course.

Figure 6A:
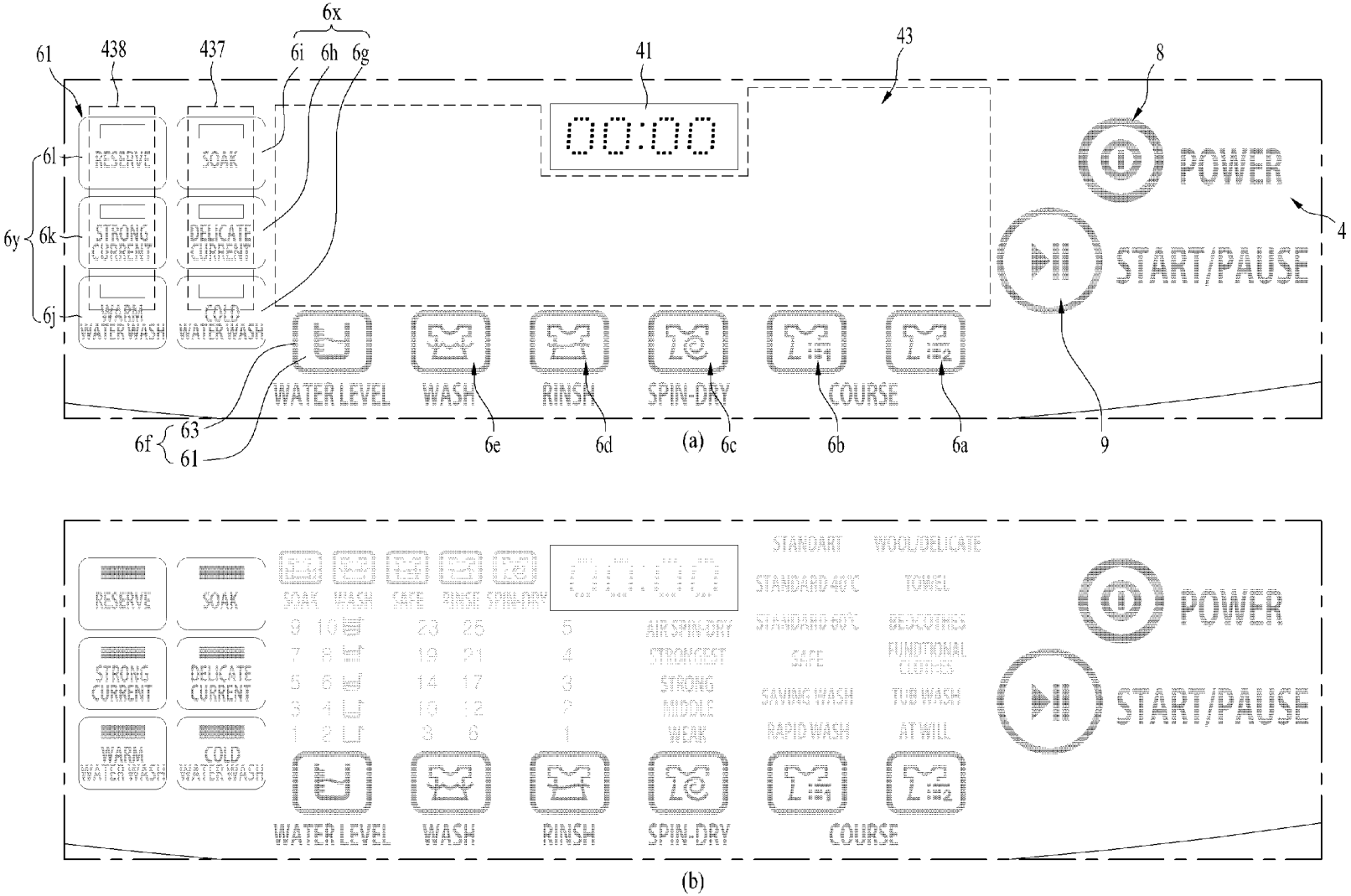
FIGS. 6A(a) to 6B(b) are views illustrating an operating process of the control panel shown in FIG. 3 *i;*

FIGS. 6A(a) to 6B(b) illustrate an example operating process of the control panel CP when a user input a power supply command to the clothes treating apparatus 100 through the power input unit 8.

The implementations of FIGS. 6A(a) to 6B(b) are characterized in that the light discharge units 43 are gradually brightened in stages and then, the target light emission unit T maintains the bright state and the background light emission units are gradually darkened and maintain a darker state than the target light emission unit T, differently from the implementations of FIGS. 5(*a*) and 5(*b*). That is, when power is supplied, the control panel CP may reach a state shown in FIG. 6B(b) in stages. The state shown in FIG. 6B(b) may be the same as the state of FIG. 5(*b*)

In some implementations, unless a user inputs the power supply command, current is not supplied to the light emission units 57 and thus, the user may not recognize the light discharge units 43 in the form of characters, figures, or marks (FIG. 6A(a)).

The timer 54 may control a time (i.e., one of the first time to the eighth time) during which current is supplied to a selected scan line while changing the scan line to which current will be supplied per millisecond (with reference to FIGS. 4(*b*) and 4(*c*)).

Therefore, when a user inputs a power supply command through the power input unit 8, the timer 54 selects one of the first scan line SC1 to the eighth scan line SC8 in the unit of one millisecond and supplies current of a regular intensity to the selected scan line for the first time (125 μs). When the controller 53 transmits the scan line supplying current to the respective light emission units 57 and a signal (the first duty cycle, 125 μs/(7 ms+825 μs)), connecting the light emission units 57 to the scan line for 125 μs through the data lines, the eight light emission unit columns 571 to 578 may maintain brightness of the lowest level (brightness of a first level) for a designated time (FIG. 6A(b)).

Figure 6B:
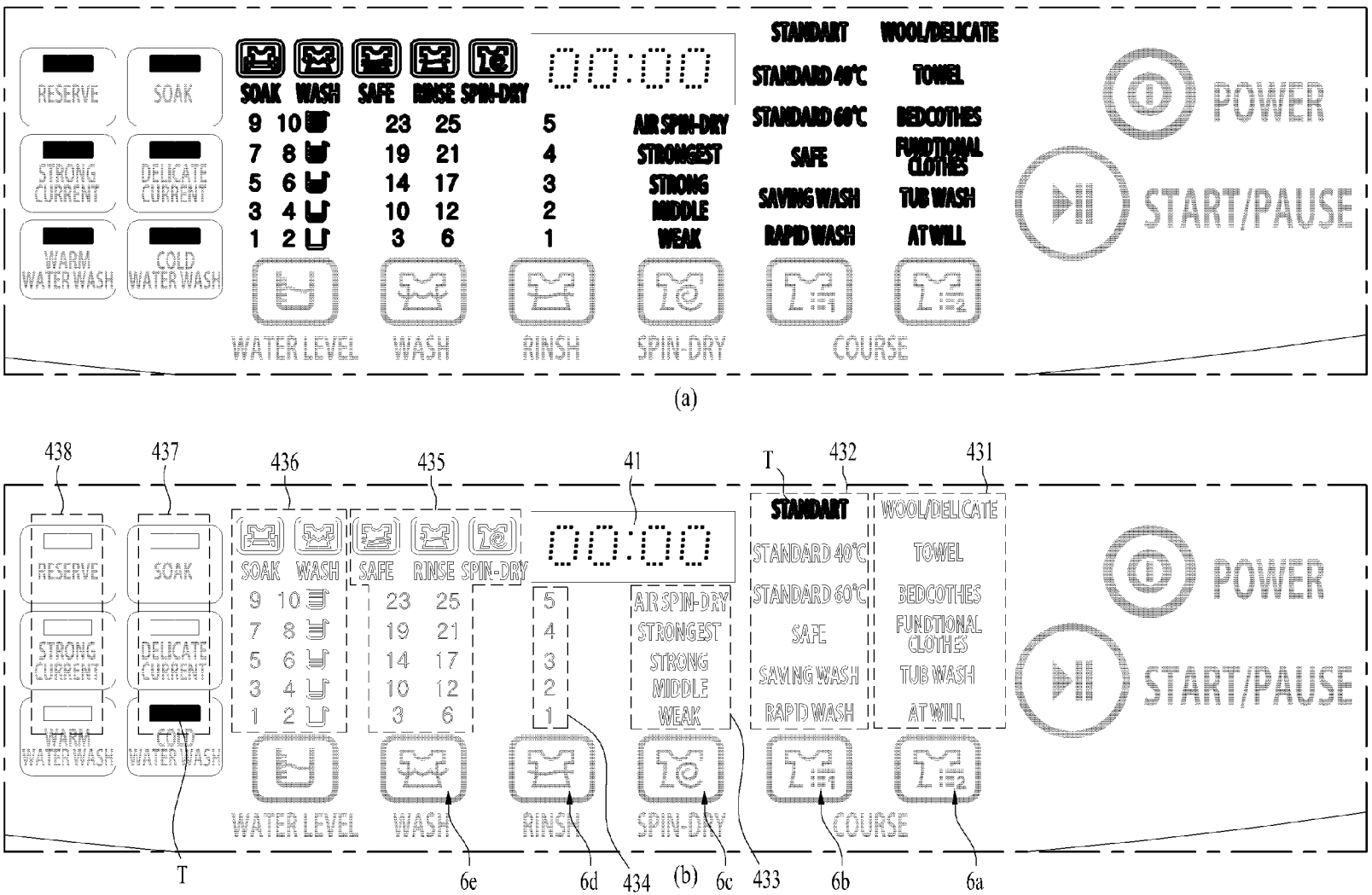

In some implementations, when the timer 54 selects one of the first scan line SC1 to the eighth scan line SC8 per millisecond and supplies current of a regular intensity to the selected scan line for the eighth time (one millisecond) and the controller 53 transmits a signal (the eighth duty cycle, ⅛) connecting all the light emission units 57 to the scan line for one millisecond through the data lines, the eight light emission unit columns 571 to 578 may maintain brightness of the highest level (brightness of a eighth level) for a designated time (FIG. 6B(a)).

Therefore, if a process of controlling the light emission units to implement brightness between the first level and the eighth level is provided between the state shown in FIG. 6A(b) and the state shown in FIG. 6B(a), the control panel may display an image in which the light discharge units 43 are gradually brightened according to at least two brightness levels.

As shown in FIG. 6B(a), when the eight light emission unit columns 571 to 578 reach brightness of the eighth level, the light emission units are controlled so that the target light emission unit maintains brightness of the eighth level but the background light emission units are gradually darkened to brightness of the first level.

That is, when the eight light emission unit columns 571 to 578 reach brightness of the eighth level, the timer 54 selects one of the first scan line SC1 to the eighth scan line SC8 per millisecond and supplies current to the selected scan line for the eighth time (one millisecond). The controller 53 may transmit a control signal (the duty cycle, ⅛), connecting the target light emission unit to the scan line for one millisecond and separating the target light emission unit from the scan line for seven milliseconds, to the target light emission unit and transmit a signal, connecting the background light emission units to the scan line only for 125 μs to the background light emission units (FIG. 6B(b)).

Therefore, the target light discharge unit T located above the target light emission unit maintains a brighter state than the remaining light discharge units and thus, a user may recognize that a course displayed by the target light discharge unit T is selected.

In the state shown in FIG. 6B(b), as the user presses the course input unit 6*b*, the target light emission unit is sequentially changed. That is, the target light emission unit of the second light emission unit column 432 corresponding to the course input unit 6*b* may be varied. Therefore, the user may recognize a selected course.

Figure 7A:
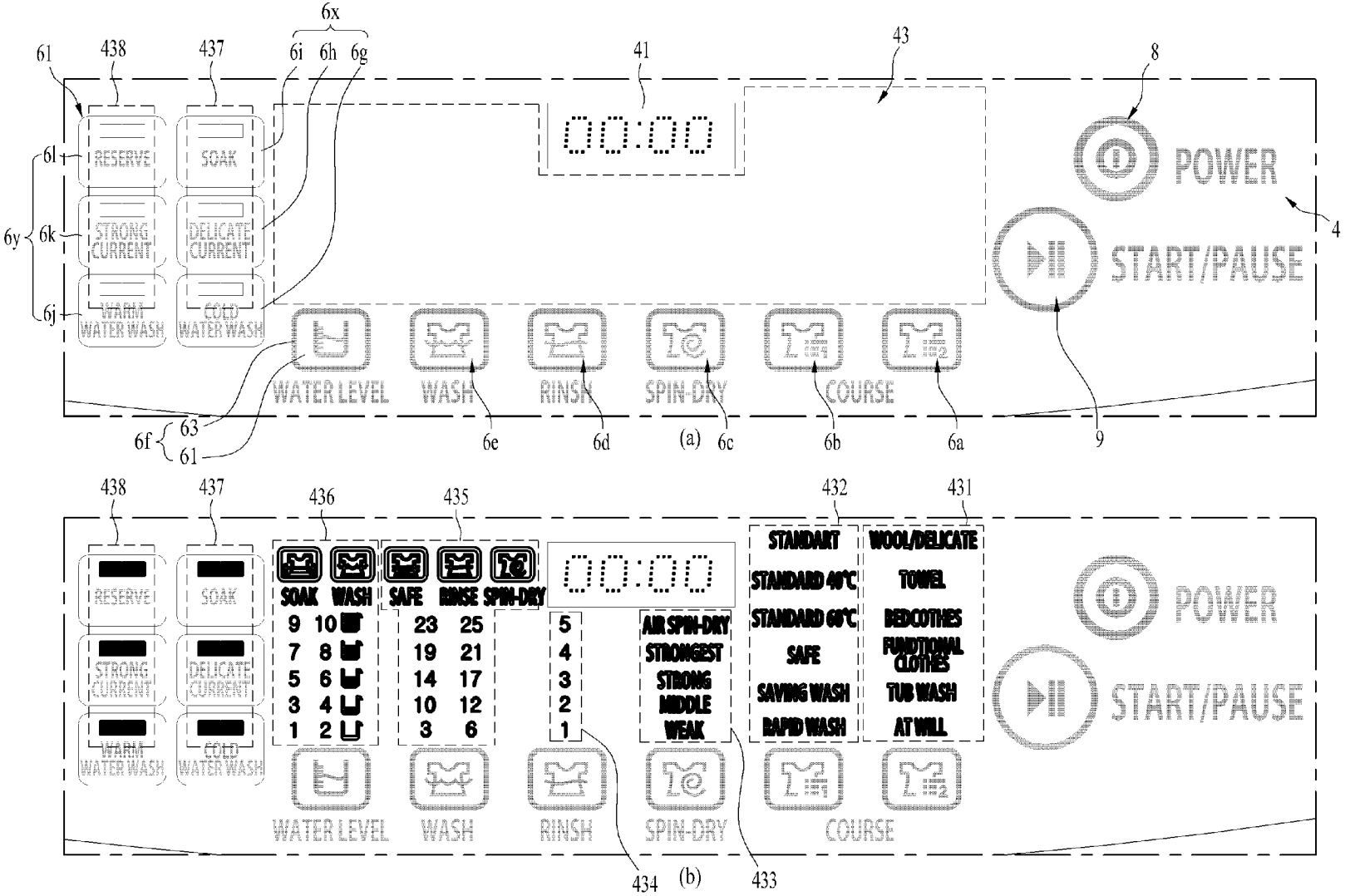
FIGS. 7A(a) to 7B are views illustrating an operating process of the control panel shown in FIG. 3.

The implementations of FIGS. 7A(a) to 7B are characterized in that, when a user inputs a power supply command through the power input unit 8, all the light emission units 57 become the brightest state (the eighth level) and then, the remaining light emission units 57 except for a target light emission unit (a light emission unit located under a target light discharge unit T) are gradually darkened and become the darkest state (the first level), differently from the implementations of FIGS. 6A(a) to 6B(b).

That is, in a state shown in FIG. 7A(a), when the user inputs the power supply command through the power input unit 8, the timer 54 selects one of the first scan line SC1 to the eighth scan line SC8 per millisecond and then, supplies current of a regular intensity to the selected scan line for the eighth time (one millisecond).

At this time, the controller 53 transmits a control signal (the duty cycle of ⅛), connecting the light emission units to the scan line for one millisecond and separating the light emission units from the scan line for seven milliseconds, to all the target light emission units. Therefore, all the light discharge units 43 may maintain the brightest state, as exemplarily shown in FIG. 7A(b).

Thereafter, the timer 54 selects one of the first scan line SC1 to the eighth scan line SC8 per millisecond and then, supplies current of a regular intensity to the selected scan line for the eighth time (one millisecond). The controller 53 may maintain the duty cycle of the target light emission unit (the duty cycle of ⅛) but lower the duty cycle of the background light emission units (transmitting a signal, connecting the background light emission units to the scan line only for 125 μs to the background light emission units).

Figure 7B:
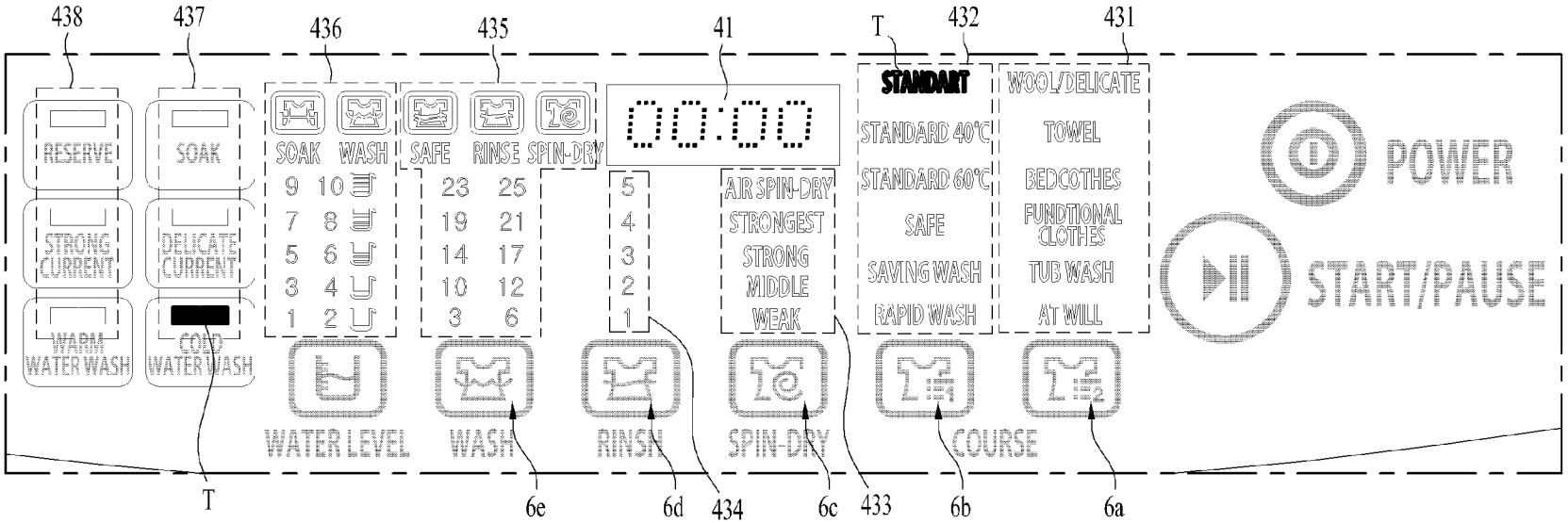

Therefore, the target light discharge unit T maintains a brighter state than the background light discharge units, as exemplarily shown in FIG. 7B, and thus, a user may recognize that a course displayed by the target light discharge unit T is selected.

If a process of controlling the light emission units to implement brightness between the first level and the eighth level is provided between the state shown in FIG. 7A(b) and the state shown in FIG. 7B, the control panel may display an image in which the light discharge units 43 are gradually darkened according to at least two brightness levels.

As described with reference to FIGS. 5(*a*) to 7B, when power is applied, the control panel CP may become the same state, as shown in FIGS. 5(*b*), 6B(a), and 7B. That is, the control panel CP becomes a state in which a user may input a control command to the control panel CP. In some implementations, brightness of the light emission units may be differently adjusted in various manners until the control panel CP becomes the state in which a user may input a control command to the control panel CP after power is applied. Therefore, the control panel CP may implement a minimal design before power is applied to the control panel CP, and have increased visibility when power is applied to the control panel CP.

Figure 8A:
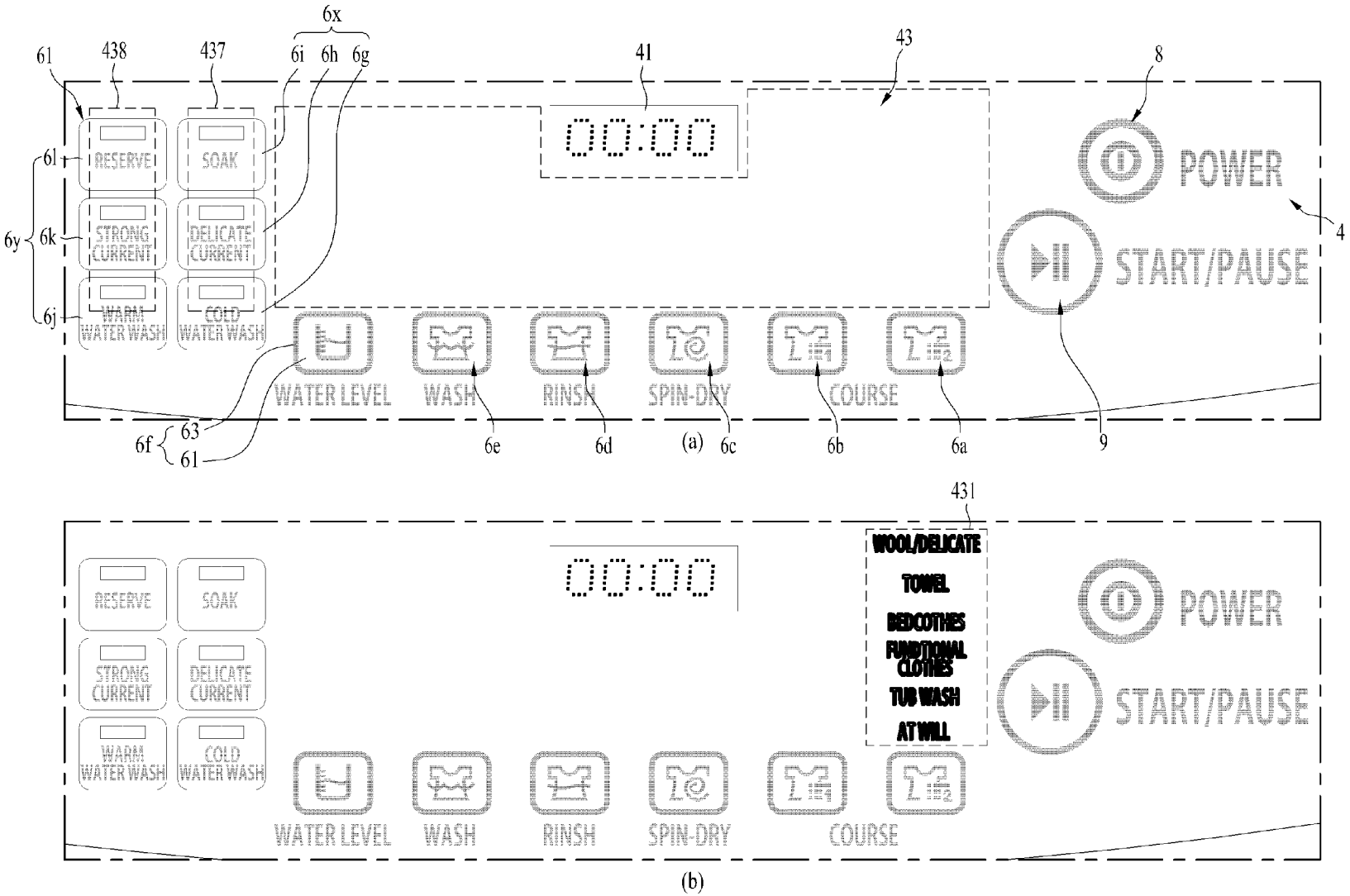
FIGS. 8A(a) to 8C are views illustrating an operating process of the control panel shown in FIG. 3.

The implementations of FIGS. 8A(a) to 8C are characterized in that, when a user inputs a power supply command through the power input unit 8, the first light emission unit column 571 to the eighth light emission unit column 578 are controlled so as to be sequentially brightened (to sequentially emit light).

In some implementations, the light emission units may be controlled so that, when one of the light emission unit columns 571 to 578 emits light, the light emission unit column previously emitting light maintains a dark state, as compared to the light emission unit column currently emitting light.

In some implementations, the light emission units may be controlled so that, when the power supply command is input, the first light emission unit column 571 maintains brightness of the eighth level for a designated time and, when a predetermined time has elapsed, the second light emission unit column 572 has brightness of the eighth level and the first light emission unit column 571 has brightness of the seventh level or less.

In a state shown in FIG. 8A(a), when a user inputs the power supply command through the power input unit 8, the timer 54 selects one of the first scan line SC1 to the eighth scan line SC8 in the unit of one millisecond and then, supplies current of a regular intensity to the selected scan line for the eighth time (one millisecond).

When current is supplied to the first scan line SC1 for the eighth time, the controller 53 transmits a control signal (the duty cycle of ⅛), connecting the light emission units to the first scan line SC1 for one millisecond, only to the light emission units forming the first light emission unit column 571. Therefore, the first light discharge unit column 431 located above the first light emission unit column 571 maintains brightness of the eighth level (the brightest state) (FIG. 8A(b)).

A time (reference time) during which the first light discharge unit column 431 maintains brightness of the eighth level may vary according to frequency of repetition of a current supply cycle. While the timer 54 supplies current only to the first scan line SC1, the brightness maintenance time is proportional to the frequency of repetition of control of supplying current only to the first light discharge unit column 431 by the controller 53.

The timer 54 supplies current of a regular intensity to the first scan line SC1 for one of the first time to the eighth time (with reference to FIG. 4(*c*)) in a cycle of eight milliseconds. Only if the first scan line SC1 is selected, the controller 53 may transmit a control signal, connecting the light emission units to the first scan line, to the light emission units forming the first light emission unit column 571. Such transmission may be performed for n cycles (n being 2 or more). Therefore, the first light emission unit column 571 may maintain brightness of a regular level for the reference time (time corresponding to a multiple of the cycle).

Once the first light emission unit column 571 emits light of brightness of a regular level for the reference time, the controller 53 transmits a control signal (the duty cycle of ⅛), connecting the light emission units to the second scan line SC2 for one millisecond, only to the light emission units forming the second light emission unit column 572, while the timer 54 supplies current to the second scan line SC2 for the eighth time (one millisecond).

At about the same time, the controller 53 transmits a control signal, connecting the light emission units to the first scan line SC1 for 875 μs, to the light emission units 57 of the first light emission unit column 571, while the timer 54 supplies current to the first scan line SC1 for the seventh time (875 μs).

Figure 8B:
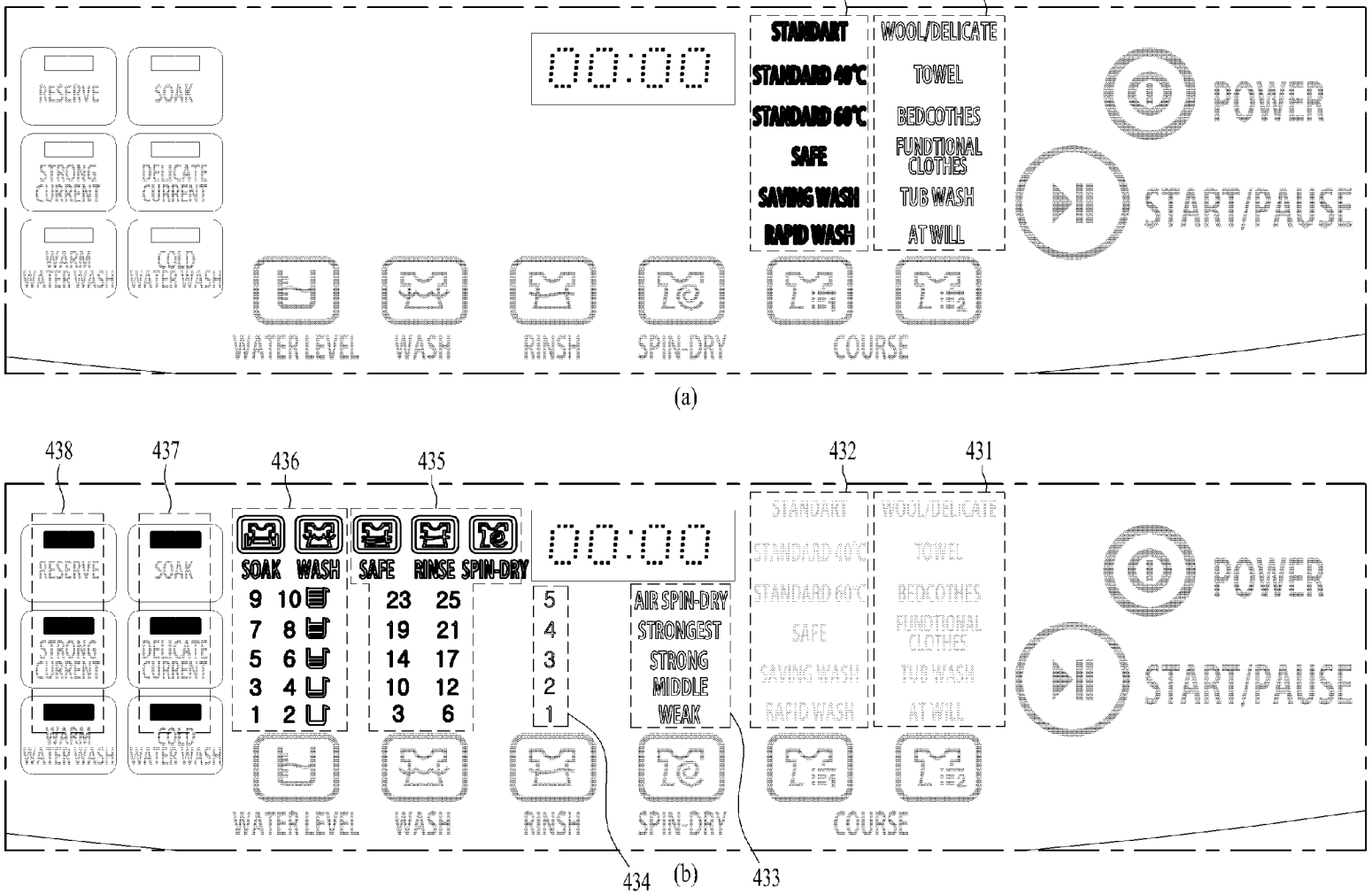

When such control is maintained for a time (reference time) corresponding to a multiple of the cycle of the scan lines, the second light discharge unit column 432 maintains the brightest state (the eighth level) for the maintenance time and the first light discharge unit column 431 maintains the darker state (the first level) than the second light discharge unit column 432 for the maintenance time (FIG. 8B(a)).

When the controller 53 controls the light emission units 57 so that the eighth light emission unit column 578 to the first light emission unit column 571 are connected to the scan lines for one millisecond, 875 μs, 750 μs, 625 μs, 500 μs, 375 μs, 250 μs, and 125 μs, while the timer 54 sequentially supplies current to the eighth scan line SC8 to the first scan line SC1 for one millisecond (the eighth time), 875 μs, 750 μs, 625 μs, 500 μs, 375 μs, 250 μs, and 125 μs (the first time), the light discharge units 43 may maintain a state in which the light discharge units 43 are gradually darkened in a direction from the eighth light emission unit column 438 to the first light emission unit column 431 (FIG. 8B(b)).

Figure 8C:
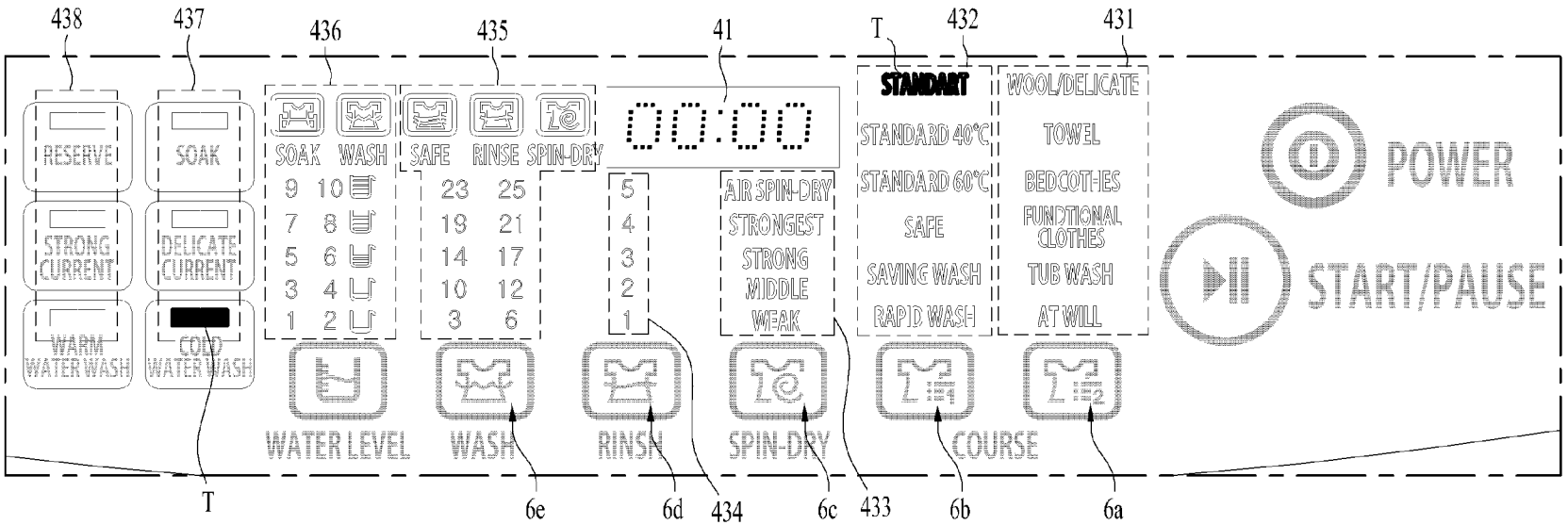

Thereafter, the timer 54 may select one of the first scan line SC1 to the eighth scan line SC8 per millisecond and then, supply current of a regular intensity to the selected scan line for the eighth time (one millisecond), and the controller 53 may transmit a control signal (the duty cycle of ⅛), connecting light emission units to the scan line for one millisecond, to the target light emission unit and transmit a control signal, connecting light emission units to the scan line only for a shorter time than one millisecond (for example, 125 μs), to the background light emission units (FIG. 8C).

In some implementations, the light emission unit column having brightness of the eighth level as moving from the first light emission unit column 571 to the eight light emission unit column 578. In some implementations, the light emission unit column having brightness of the eighth level may move from the eighth light emission unit eighth column to the first light emission unit first column 571.

In some implementations, a light emission unit row having brightness of the eighth level may move from the lower end of the panel body 4 to the upper end of the panel body 4 or move from the upper end of the panel body 4 to the lower end of the panel body 4.

In some implementations, a light emission unit column of a diagonal line type having brightness of the eighth level may move from an upper corner of the panel body 4 to a lower corner of the panel body 4.

In some implementations, the eight light emission unit columns have a brightness of different levels, and the light emission unit column maintaining brightness of the eighth level may move from one side of the panel body 4 to the other side of the panel body 4 but the remaining light emission unit columns may be fixed to brightness of a low level (the first level or the second level).

That is, once the second light emission unit column 572 emits light of brightness of the eighth level for the reference time, the controller 53 may control the light emission units 57 so that the third light emission unit column 573 emits light of brightness of the eighth level for the reference time and the second light emission unit column 572 and the first light emission unit column 571 maintain brightness of the first level for the reference time.

In more detail, the scan lines may be controlled so that the timer 54 supplies current to the third scan line SC3 for the eighth time (one millisecond) and supplies current to the second scan line SC2 and the first scan line SC1 for the first time (125 μs). Further, the controller 53 may transmit a control signal (the duty cycle of ⅛), connecting the light emission units to the third scan line SC3 for one millisecond, to the light emission units forming the third light emission unit column 573 and transmit a signal, connecting the light emission units 57 to the second scan line SC2 and the first scan line SC1 for 125 μs, to the second light emission unit column 572 and the first light emission unit column 571. Thereby, the above-described control may be carried out.

Further, control of the light discharge units 43 according to the eight brightness levels may be carried out because the timer 54 in the above-described implementation selects one scan line per millisecond and the current supply minimum time is set to 125 μs. Therefore, the number of brightness levels of the light discharge units 43 may be modified according to specifications of the timer 54.

As described with reference to FIGS. 5(*a*) to 8C, when power is applied, the control panel CP becomes the same state, as shown in FIGS. 5(*b*), 6B(a), 7B, and 8C. That is, the control panel CP becomes a state in which a user may input a control command to the control panel CP. In some implementations, brightness of the light emission units may be differently adjusted in various manners until the control panel CP becomes the state in which a user may input a control command to the control panel CP after power is applied. Therefore, the control panel CP may implement a minimal design before power is applied to the control panel CP, and have excellent appearance and increased visibility when power is applied to the control panel CP.

In some implementations, this disclosure may be applied to control of one light emission unit.

In some implementations, control panel CP is applied to the top loading type clothes treating apparatus in which the clothes receipt unit 2 is provided in a direction vertical to the bottom surface of the cabinet 1. In some implementations, the control panel CP may be applied to a front loading type clothes treating apparatus in which a clothes receipt unit 2 is provided in parallel with the bottom surface of a cabinet 1.

As apparent from the above description, a control panel through which a control command may be input using bioelectric currents of a user, and a clothes treating apparatus having the same may be provided.

In some implementations, a control panel which prevents a clothes treating apparatus from being operated against user intention even if bioelectric currents is input through two or more input units and a clothes treating apparatus having the same may be provided.

In some implementations, a control panel which may control brightness of light emission units through a time during which current is supplied and a clothes treating apparatus having the same may be provided.

In some implementations, a control panel in which a plurality of light emission units emits light in various patterns when a power supply signal is input to a clothes treating apparatus and a clothes treating apparatus having the same may be provided.

In some implementations, a control panel which a user may clearly recognize selection of a course displayed by a target light emission unit through a difference of brightness levels between the target light emission unit and background light emission units, a clothes treating apparatus having the control panel, and a control method thereof may be provided.

In some implementations, a control panel in which a user may clearly recognize whether or not a control command displayed by light discharge units is preset and whether or not the control command is selected by varying brightness levels of light emission units emitting light toward the light discharge units when power is supplied, a clothes treating apparatus having the control panel, and a control method thereof may be provided.

In some implementations, a control panel which may implement various initial light emitting patterns of light emission units after power is supplied and thus improve product satisfaction, a clothes treating apparatus having the control panel, and a control method thereof may be provided.

What is claimed is:

1. A control method of a control panel of a clothes treating apparatus that comprises:

a panel body that defines an external appearance of the control panel, a plurality of light discharge units that are located on the panel body, and a plurality of light emission units that are located under the plurality of light discharge units, that are configured to emit light toward the plurality of light discharge units, and that include a target light emission unit and a background light emission unit within a same light emission unit, the method comprising:

receiving, at the clothes treating apparatus, a power supply command from a user through a power input unit; and based on receiving power to the control panel, emitting light from the target light emission unit that is brighter than light emitted from the background light emission unit by providing current that has a first duty cycle to the target light emission unit and current that has a second duty cycle to the background light emission unit, the first duty cycle and the second duty cycle being based on fractions of the duty cycle of current supplied to each of the plurality of light emission units, wherein the first duty cycle of the target light emission unit and the second duty cycle of the background light emission unit are separately generated and controlled by a controller, wherein the plurality of light emission units are located in a matrix comprising a plurality of light emission unit columns and a plurality of light emission unit rows, wherein a plurality of scan lines are each configured to connect light emission units of a respective light emission unit column, each light emission column receiving substantially equal current through a respective scan line in successive intervals of substantially equal duration, and wherein a plurality of data lines are each configured to connect light emission units of a respective light emission unit row and configured to control a time during which a particular light emission unit receives current through a particular scan line.

2. The control method of claim 1, wherein:

the first duty cycle of the target light emission unit is greater than the second duty cycle of the background light emission unit.

3. The control method of claim 2, wherein the first duty cycle of the target light emission unit is approximately four times the second duty cycle of the background light emission unit.

4. The control method of claim 1, wherein a timer controls supply times of current supplied through the plurality of scan lines.

5. The control method of claim 4, wherein current is supplied to the plurality of scan lines at different times and is supplied to the respective scan line according to a designated cycle of the timer.

6. The control method of claim 4, wherein the timer supplies current to the plurality of scan lines according to a plurality of current supply times.

7. The control method of claim 6, wherein the plurality of current supply times includes 1 ms, 875 μs, 750 μs, 625 μs, 500 μs, 375 μs, 250 μs, and 125 μs.

8. The control method of claim 1, wherein:

the control panel includes the controller that operates the clothes treating apparatus according to a control command input through one or more input units; and the controller transmits a signal to each light emission unit through the plurality of data lines, the signal connecting a respective light emission unit to the respective scan line.

9. The control method of claim 1, wherein the controller:

transmits a first signal to the target light emission unit through the plurality of data lines, the first signal connecting the target light emission unit to the respective scan line and separating the target light emission unit from the respective scan line in the first duty cycle of the target light emission unit; and transmits a second signal to the background light emission unit through the plurality of data lines and not to the target light emission unit, the second signal connecting the background light emission unit to the respective scan line and separating the background light emission unit from the respective scan line in the second duty cycle of the background light emission unit.

10. The control method of claim 1, wherein the target light emission unit is preset.

11. The control method of claim 1, wherein the target light emission unit is set through selection of input units by the user.

12. The control method of claim 1, wherein:

the target light emission unit is configured to emit light at a first level, and the background light emission units are configured to emit light at a second level, the first level being brighter than the second level.

13. The control method of claim 12, wherein, based on receiving power to the control panel, the background light emission unit is configured to emit light at the second level and the target light emission unit, which is set through selection of one or more input units by the user, is configured to emit light at the first level.

14. The control method of claim 12, wherein:

based on receiving power to the control panel, the target light emission unit and the background light emission unit are gradually brightened in stages, and after the target light emission unit and the background light emission unit are gradually brightened, the target light emission unit maintains light emission at the first level and the background light emission unit is gradually darkened and maintains light emission at the second level.

15. The control method of claim 12, wherein:

based on receiving power to the control panel, the target light emission unit and the background light emission unit are brightened in the state of a brightest level, and the target light emission unit maintains light emission at the first level and the background light emission unit is gradually darkened and maintains light emission at the second level.

16. The control method of claim 1, wherein:

the light discharge unit displays control commands selectable by a user through one or more input units on the panel body of the control panel, and the light emission unit corresponding to a control command selected through the one or more input units is controlled by the first duty cycle of the target light emission unit.

17. A control panel of a clothes treating apparatus comprising:

a panel body that defines an external appearance of the control panel;

a light discharge unit that is located on the panel body and that includes at least one of characters, figures, or marks;

light emission units that are located adjacent to the light discharge unit, that are located in a matrix comprising a plurality of light emission unit columns and a plurality of light emission rows, that are configured to emit light toward the light discharge unit, and that include a target light emission unit and a background light emission unit within a same light emission unit; and a control unit configured to control brightness of the emitted light from the light emission units, wherein the control unit, by controlling the target light emission unit, emits light from the target light emission unit that is brighter than light emitted from the background light emission unit by providing current that has a first duty cycle to the target light emission unit and current that has a second duty cycle to the background light emission unit, the first duty cycle and the second duty cycle being based on fractions of the duty cycle of current supplied to each of the plurality of light emission units, and wherein the control unit includes:

a controller;

a plurality of scan lines that are each configured to connect light emission units of a respective light emission unit column, each light emission column receiving substantially equal current through a respective scan line in successive intervals of substantially equal duration;

a timer that is configured to connect the plurality of scan lines to the controller and that is configured to supply current to the plurality of scan lines according to a predetermined cycle; and a plurality of data lines that are each configured to connect light emission units of a respective light emission row and that are each configured to control a duty cycle in which a particular light emission unit receives a substantially equal current in a regular cycle through a particular scan line.

* * * * *